United States Patent [19]

McGuerty

[11] 4,372,190

[45] Feb. 8, 1983

[54] SAXOPHONE MOUTHPIECE HAVING REED ADJUSTMENT MEANS

[76] Inventor: Jay S. McGuerty, 115 Beckham Way, Cincinnati, Ohio 45246

[21] Appl. No.: 304,846

[22] Filed: Sep. 23, 1981

Related U.S. Application Data

[63] Continuation-in-part of Ser. No. 202,684, Oct. 31, 1980, abandoned.

[51] Int. Cl.[3] ..... G10D 9/02

[52] U.S. Cl. ..... 84/383 R

[58] Field of Search ..... 84/383 R

[56] References Cited

U.S. PATENT DOCUMENTS 1,449,868 3/1923 Miller ..... 84/383 R 3,150,554 9/1964 Leloup ..... 84/383 R

FOREIGN PATENT DOCUMENTS 270034 5/1927 United Kingdom ..... 84/383 R

*Primary Examiner*—Lawrence R. Franklin

*Attorney, Agent, or Firm*—Frost & Jacobs

[57] ABSTRACT

An adjusting mechanism for longitudinally positioning the reed on the mounting face of a woodwind musical instrument mouthpiece. In one embodiment, the adjustment mechanism includes a micrometer-type screw threadedly engaging a ligature body secured to the mouthpiece which operates a yoke connected to the rear edge of the reed to move the reed tip with respect to the arcuate mouthpiece edge. A pair of longitudinally spaced vertically adjustable rollers bear against the outer surface of the reed to provide transverse pressure for holding the reed in place, while permitting longitudinal movement. The apparatus permits precise positioning of the reed to produce optimum performance with minimum adjustment time. In a second embodiment, the reed is adjustable by means of a lever arm linkage operated by an adjustment screw located on the bottom of the adjustment mechanism. The reed is advanced or retracted by means of a grooved roller which may cooperate with matching grooves on the reed surface. In another embodiment, adjustment is provided directly or through a gear mechanism by a thumb wheel connected to the grooved roller.

26 Claims, 20 Drawing Figures

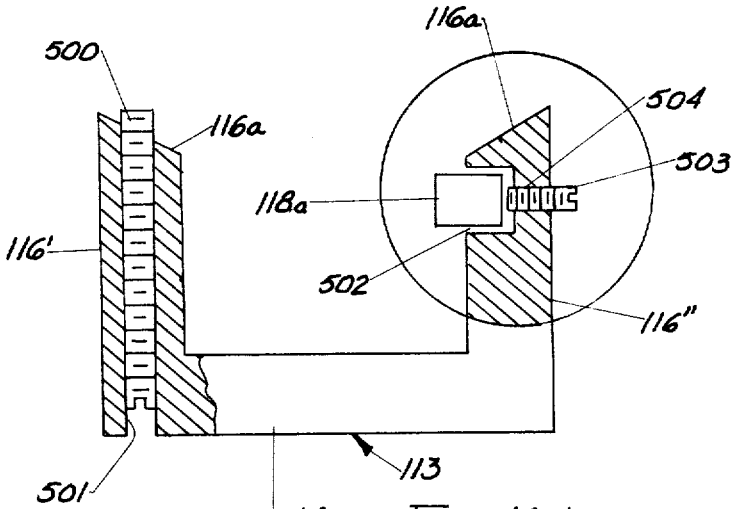
Fig. 19-A
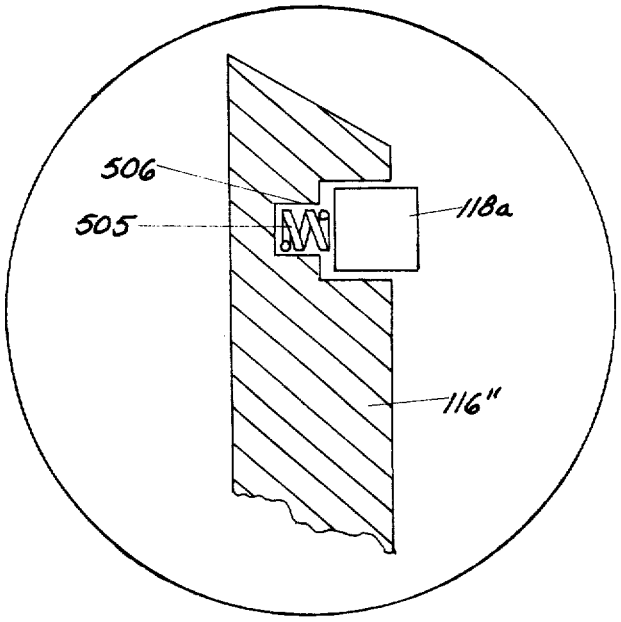
Fig. 19-B

SAXOPHONE MOUTHPIECE HAVING REED ADJUSTMENT MEANS

SUMMARY OF THE INVENTION

This application is a continuation-in-part of my earlier application entitled Saxophone Mouthpiece Having Micrometer Type Reed Adjustment Means, Ser. No. 06/202,684, filed Oct. 31, 1980, now abandoned.

The present invention is directed generally to woodwind musical instruments, and more particularly to apparatus for permitting longitudinal adjustment of the reed on the instrument mouthpiece.

It is well known that the position of the reed on a conventional woodwind musical instrument mouthpiece can greatly influence the sound and playing characteristics of the instrument. For any given reed and mouthpiece combination, an optimum point can be found for positioning the tip of the reed in relation to the tip of the mouthpiece. Historically, musicians have positioned the reed by trial and error to achieve the optimum sound. It has been found, however, that this procedure is inefficient and time consuming since the ligature must be adjusted each time the reed is moved. Great difficulty has also been encountered in moving the reed in small increments with respect to the mouthpiece.

Various methods have been suggested for clamping the reed to the mouthpiece in such a way as to vary the transverse force on the reed clamping surface, or the angle which the reed makes with the mouthpiece face. Such techniques are well known and are illustrated, for example, in U.S. Pat. No. 2,496,749 issued Feb. 7, 1950 to L. R. Reddick and in U.S. Pat. No. 3,413,884 issued Dec. 3, 1968 to G. Sciacca.

While such devices serve to vary the force applied to the reed, they are incapable of longitudinally moving the reed, particularly when it is clamped to the mouthpiece, to vary the position of the tip of the reed in relation to the tip of the mouthpiece.

The present invention, on the other hand is directed to a ligature arrangement which not only serves as a clamping device, but also permits the reed to be precisely adjusted along the longitudinal axis to permit the optimum operational position to be quickly and easily located.

In a preferred embodiment, the present invention is useful with woodwind musical instrument mouthpieces of the type including a hollow member having a mouth engaging end terminating in a generally arcuate edge and a lower face extending forwardly of the edge which is configured to mount an elongated reed having a front tip positioned adjacent the arcuate edge and a rear edge surface extending downwardly from the lower face. The present invention is particularly adaptable to saxophone and clarinet mouthpieces, and comprises means for accurately adjusting the longitudinal position of the reed on the mouthpiece to place the reed tip at a desired location with respect to the arcuate edge.

In one embodiment, the adjustment means includes an elongated channel-shaped ligature body mounted on the mouthpiece face and having a generally planar horizontal web portion bearing a downwardly depending boss, with flange members extending upwardly from each outer edge of the web adjacent the marginal edges of the reed. The ligature body may be fixedly attached to the mouthpiece by means of a band-like strap.

A micrometer adjusting screw extending parallel to the reed threadedly engages the boss, and is rotatably secured to a reed yoke, which threadedly engages the rear edge surface of the reed. Consequently, rotation of the screw in the ligature body boss causes longitudinal movement of the reed to move the reed tip toward and away from the arcuate edge of the mouthpiece.

Means are also provided for urging the reed at spaced points along its length against the mouthpiece face. Each of these means includes a U-shaped roller harness having a lower horizontal web section overlying the ligature body web portion and an arm extending upwardly from each side edge of the web portion adjacent the ligature body flange members. A vertical tab extends outwardly from each of the roller harness arms and slidably engages a vertically extending slot formed in the inner wall surface of each of the flange members, permitting the roller harness to move vertically. A cylindrical roller is rotatably mounted within the roller harness between the roller harness arms and is configured and positioned to bear against the outer surface of the reed. A vertically extending pressure adjusting screw threadedly engages the ligature body web portion, with the upper end of the screw bearing against the lower surface of the roller harness web portion to vertically position the roller harness to urge the roller against the reed. Rotational movement of the roller permits longitudinal movement of the reed while the entire mechanism is positioned on the mouthpiece.

In a second embodiment, longitudinal adjustment of the reed is accomplished by means of an adjustment screw located on the bottom of the adjustment means which operates a lever arm non-rotatably connected to a grooved roller having one surface in contact with the under surface of the reed. Axial adjustment of the adjustment screw causes a pivotal motion of the lever arm, imparting a rolling motion to the roller and linear motion to the instrument reed. The lever arm and roller may be moved to an alternate position to faciliate insertion or removal of the reed from the mouthpiece and adjustment mechanism.

In addition, integral tapered side guides are provided for minimizing transverse movement of the reed during adjustment.

In a third embodiment, longitudinal adjustment of the reed is accomplished by a grooved roller having a surface in contact with the under surface of the reed which may be rotated by a thumb wheel located on the side of the adjustment means. Rotary motion may be transmitted to the grooved roller directly, or through a spur gear train. In addition, the outer surface of the reed in contact with the grooved roller may be provided with a rack-type gear portion to insure positive engagement with the grooved roller. Alternately, the rack-type gear may be provided with an adhesive surface and attached to the outer surface of the instrument read.

Further features of the invention will become apparent from the detailed description which follows.

BRIEF DESCRIPTION OF THE DRAWING

FIG. 19A is an enlarged partially cross-sectional view of an alternate embodiment for the flange member of FIG. 14.

FIG. 19B is an enlarged fragmentary cross-sectional view of an alternate embodiment of FIG. 19A.

DETAILED DESCRIPTION

Figure 1:
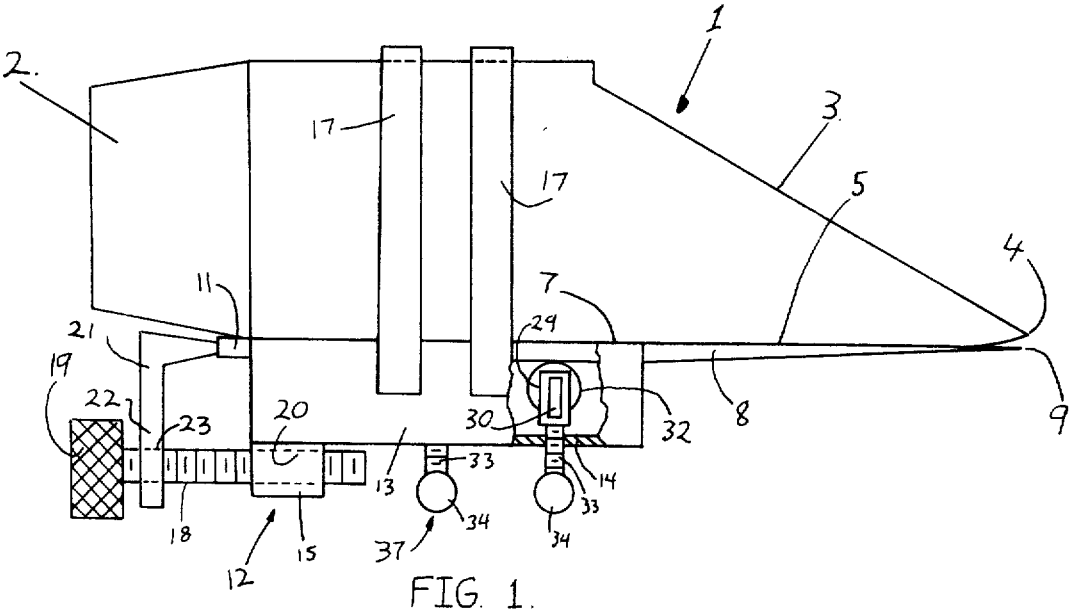
FIG. 1 is a partially cutaway side elevation view of the mouthpiece of the present invention.
Figure 7:
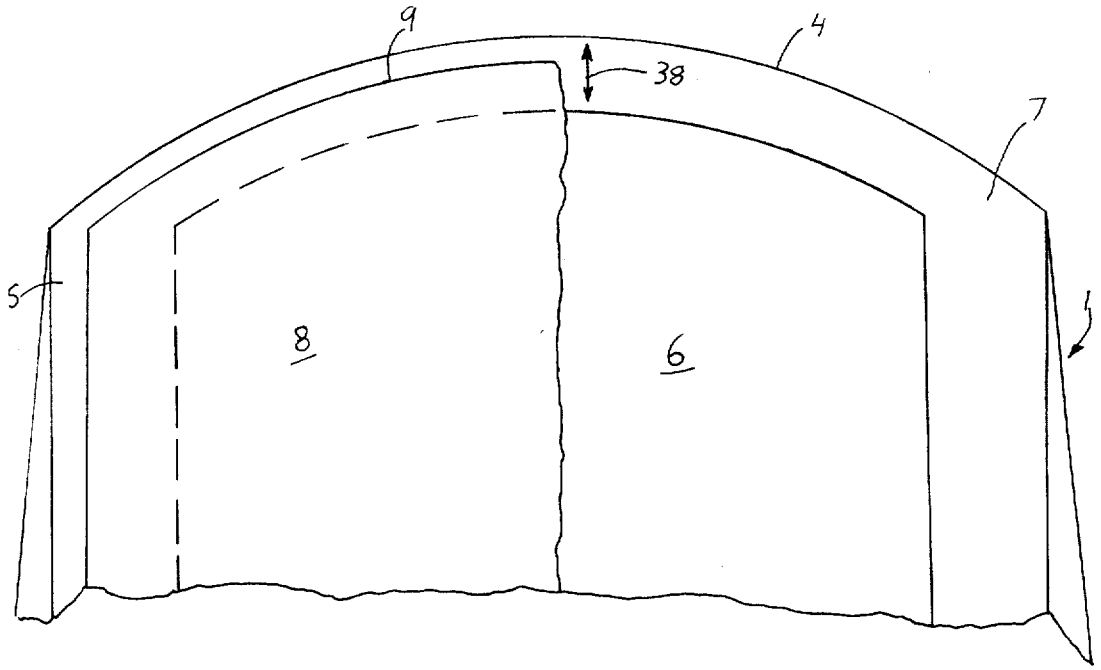
FIG. 7 is a fragmentary enlarged bottom plan view of the mouthpiece tip.

FIG. 1 illustrates the present invention in combination with a conventional musical instrument mouthpiece shown generally at 1, of the type including a hollow member 2 having a mouth engaging end 3 terminating in a generally arcuate edge 4. A lower face 5 extends forwardly of edge 4 and includes a centrally positioned opening 6 (see FIG. 7). The marginal area surrounding opening 6 as well as the area positioned rearwardly of opening 6 forms a flat lower face 7 configured to mount an elongated reed 8.

Figure 2:
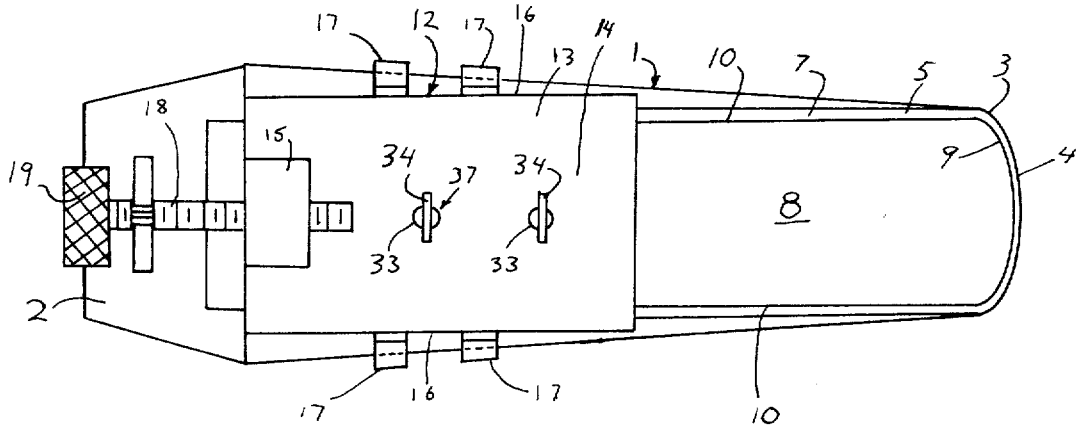
FIG. 2 is a bottom plan view of the mouthpiece of the present invention.

Reed 8 has a generally arcuate front tip portion 9 which is positioned adjacent arcuate edge 4, marginal edges 10 (see FIG. 2), and a rear edge surface 11 spaced rearwardly from tip 9 and extending downwardly from lower face 7. The foregoing description is substantially conventional in nature.

The improvement of the present invention includes means, shown generally at 12, for accurately adjusting the longitudinal position of reed 8 on mouthpiece 1 to place the reed tip portion 9 at a desired location with respect to arcuate edge 4.

In a first preferred embodiment, adjustment means 12 includes an elongated channel-shaped ligature body 13 mounted on mouthpiece face 7 and having a generally planar horizontal web portion 14 bearing a downwardly depending boss 15. A flange member 16 extends upwardly from each outer edge of web 14 adjacent the marginal edges 10 of reed 8. The upper edges of flange members 16 are configured to abut the flat surface of mouthpiece face 7.

Adjustment means 12 also includes ligature means for fixedly securing ligature body 13 to mouthpiece 1. In the embodiment illustrated, the securing members comprise a pair of spaced flat straps 17 having upper ends fixedly attached to ligature body 13, and lower arcuate portions which surround the body of mouthpiece 1 to hold the adjustment means securely in place.

A micrometer adjusting screw 18 bearing a knurled grasping portion 19 extends in a direction parallel to reed 8 and threadedly engages boss 15 at 20.

A flat plate-like reed yoke 21 including a vertically extending arm 22 bearing a centrally located slot 23 is rotatably secured to micrometer adjusting screw 18 by a reduced portion 24 of the screw which nicely fits into slot 23. The lower end of reed yoke 21 terminates in a forwardly extending threaded fastener portion 25 which pierces and threadedly engages the rear edge surface 11 of reed 8 as at 26. As shown in FIG. 1, rotation of the micrometer adjusting screw will cause longitudinal movement of the reed in order to move the reed tip toward and away from the arcuate edge 4 of the mouthpiece.

Means are also provided for uging the reed against the mouthpiece face. The urging means include a U-shaped roller harness 27 having a lower horizontal web section 28 overlying the ligature body web portion 14, and an arm 29 extending upwardly from each side edge of web portion 27 adjacent ligature body flange members 16.

Figure 3:
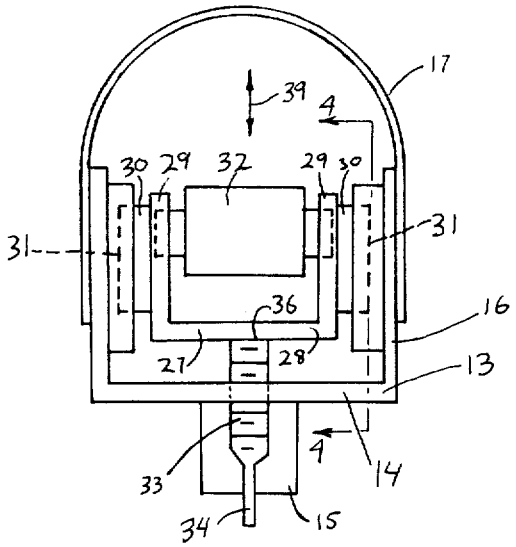
FIG. 3 is an end view of the adjustment means of the present invention removed from the mouthpiece.
Figure 4:
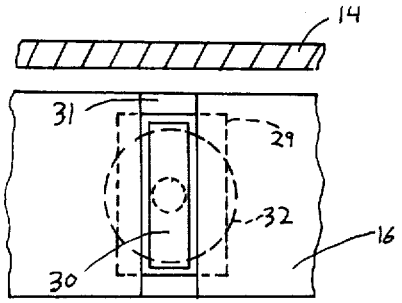
FIG. 4 is an inverted enlarged fragmentary cross sectional view taken along section line 4—4 of FIG. 3.
Figure 5:
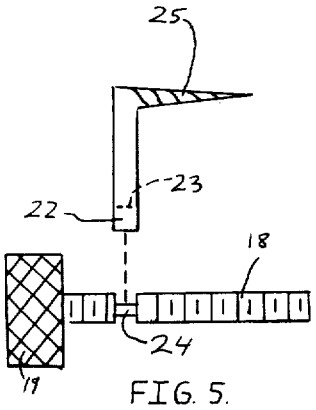
FIG. 5 is an enlarged exploded view illustrating the construction of the micrometer adjustment screw and reed yoke.

Means slidably secure roller harness 27 to the ligature body 13 for vertical movement therebetween. The securing means comprises a vertical tab 30 extending outwardly from each of roller harness arms 29 which is configured to slidably engage a vertically extending slot or groove 31 formed in the inner wall surface of each of flange members 16 (see FIG. 3 and FIG. 4).

A cylindrical roller 32 is rotatably mounted between roller harness arms 29 within the roller harness. Roller 32 is positioned and configured to bear against the outer surface of reed 8 as best shown in FIG. 1.

A vertically extending pressure adjusting screw 33 having a flat graspable portion 34 threadedly engages ligature body web portion 14 as at 35. The upper end 36 of pressure adjusting screw 33 bears against the lower surface of roller harness web portion 28 of the roller harness to urge roller 32 against the outer surface of reed 8. It will be observed that this arrangement permits a transverse force to be applied against the reed to hold it against the mouthpiece face, while permitting longitudinal movement of the reed by means of the adjusting means. If desired, a second similar urging means shown generally at 37, may be positioned between the urging means just described and boss 15 to provide a transverse pressure to reed 8.

Figure 6:
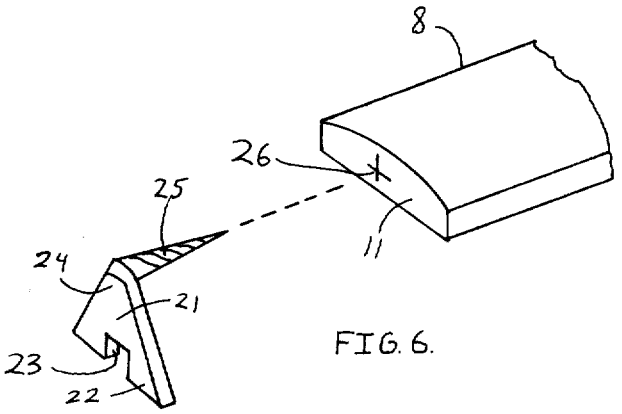
FIG. 6 is a fragmentary exploded perspective view illustrating the connection of the reed yoke with the reed.
Figure 8:
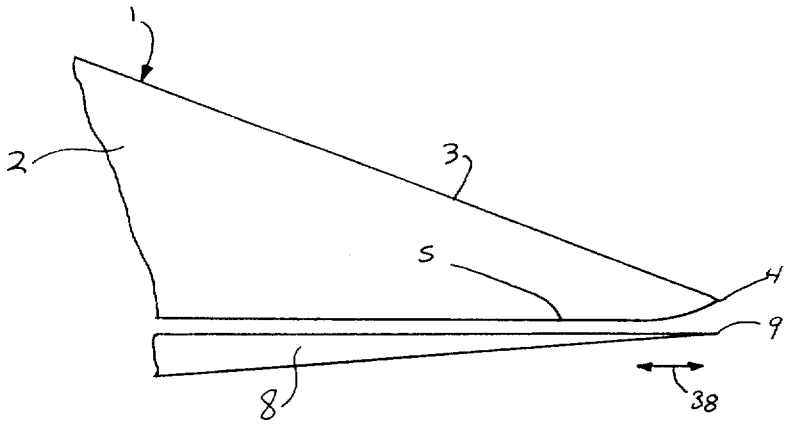
FIG. 8 is an enlarged fragmentary side elevation view of the mouthpiece tip.
Figure 9:
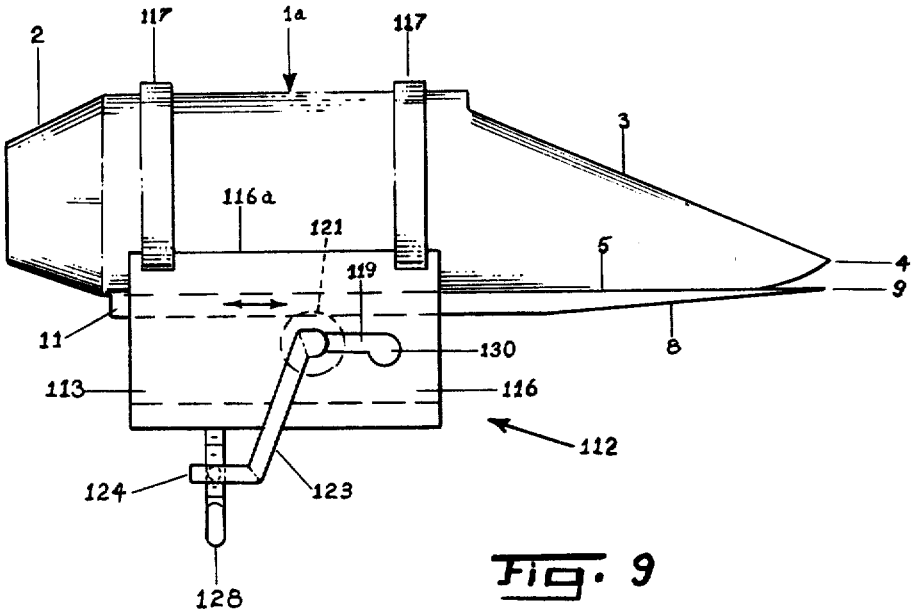
FIG. 9 is a side elevation view of a second embodiment of the mouthpiece of the present invention.

In operation, reed yoke 21 is attached to reed 8 as illustrated in FIG. 6, and the reed positioned against the flat face 7 of mouthpiece 1 as illustrated in FIG. 1 with the yoke arm 22 projecting downwardly. The adjusting means 12 may then be positioned on the mouthpiece, and strap 17 secured to hold the means securely in place against the mouthpiece body. Micrometer adjusting screw 18 may be rotated to move reed tip 9 toward and away from arcuate edge 4 as illustrated by the directional arrows 38 in FIG. 7 and FIG. 8. Pressure adjusting screw 33 may then be rotated to move roller 32 upwardly or downwardly in the direction illustrated by directional arrow 39 in FIG. 3 to provide the desired amount of transverse pressure against the reed 8. If necessary, micrometer adjusting screw 18 may then be manipulated to accurately position longitudinally the reed on the mouthpiece to place the reed tip at the optimum location with respect to the arcuate edge of the mouthpiece.

A second embodiment of the present invention is illustrated in FIG. 9–FIG. 12, where elements similar to those perviously described have been similarly designated. As in the previous embodiment, means, shown generally at 112, are provided for urging the reed against the mouthpiece and for accurately adjusting the longitudinal position of reed 8 on mouthpiece 1 to place the reed tip portion in a desired location with respect to arcuate edge 4.

Figure 11:
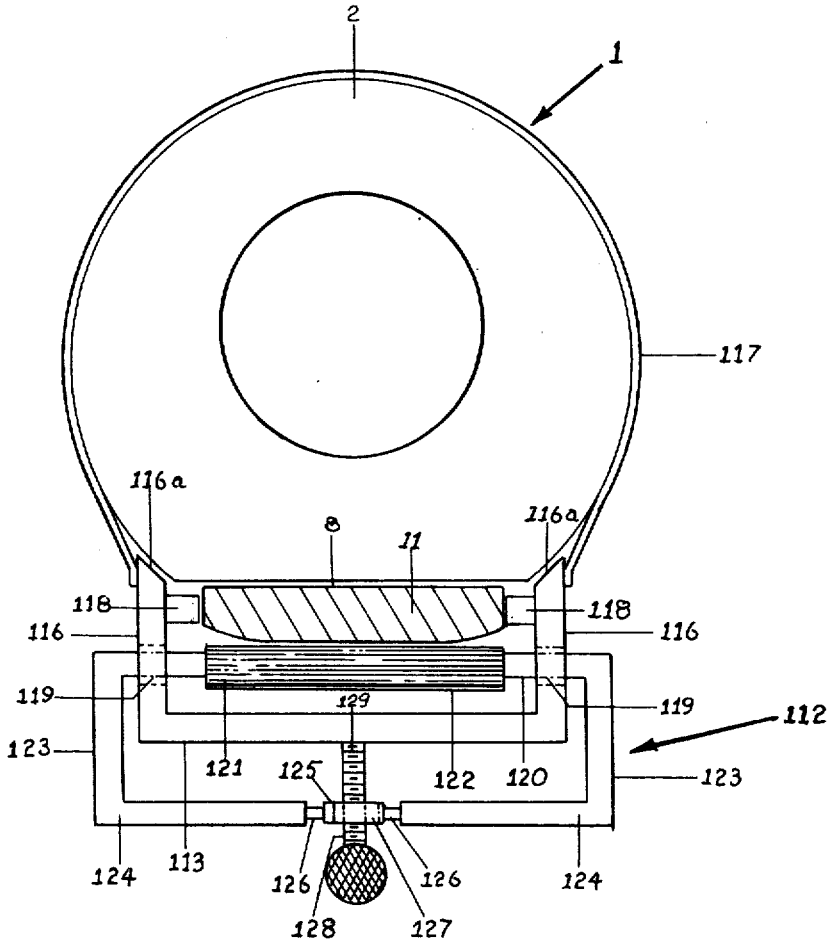
FIG. 11 is an enlarged end elevation view of a second embodiment of the mouthpiece of FIG. 9.
Figure 12:
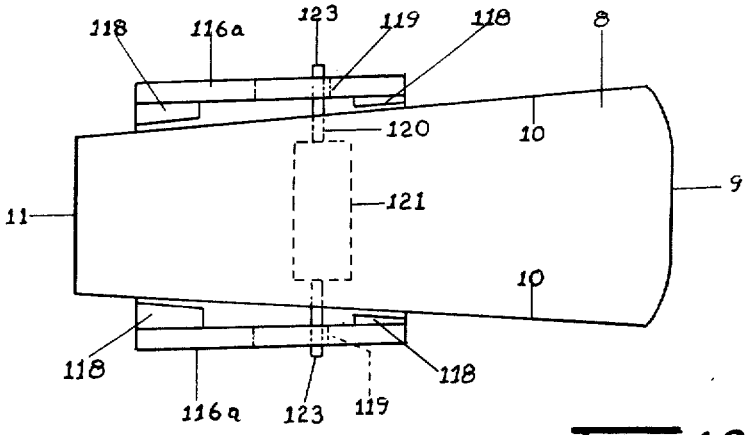
FIG. 12 is a top plan view of the mouthpiece of FIG. 9.

Adjustment means 112 includes an elongated channel or U-shaped ligature body 113 mounted on mouthpiece face 7 and having a generally planar horizontal web portion 114. A flange member 116 extends upwardly from each outer edge of web portion 114 adjacent the marginal edges 10 of reed 8. As best shown in FIG. 11, the longitudinally extending upper edges of flange members 16 are beveled as at 116*a* to abut the arcuate outer surface of mouthpiece 1.

Ligature body 113 is secured to mouthpiece 1 by a pair of spaced arcuate straps 117 having lower edges fixedly secured to the upper ends of flange members 116. Straps 117 may be adjusted as described hereinabove in connection with the embodiment of FIG. 1–FIG. 8 to securely hold adjustment means 112 in position on the instrument mouthpiece.

A pair of spaced inwardly directed guides 118 are fixedly secured to the inner surface of flange members 16 near the upper edge thereof, and at positions adjacent the forward and rearward edges thereof. The inner surfaces of guides 118 are tapered so as to make sliding contact with the outer edges of reed 8 as it is adjusted longitudinally in order to laterally restrain the reed.

Flange members 116 are each provided with a longitudinally extending elongated slot 119 which rotatably support the ends of a cylindrical shaft 120 having an enlarged cylindrical central portion or roller 121 bearing a plurality of circumferentially spaced axially extending ridges, as at 122.

Each outermost end of shaft 120 terminates in a generally downwardly extending lever arm 123. The lowermost ends of lever arms 123 terminate in inwardly directed support members 124 as best shown in FIG. 11. A plate-like member 125 is gimballed at each end as at 126 to opposing inner ends of members 124 as best shown in FIG. 11. Gimballed plate 125 is provided with an aperture 127 for threadedly accepting an adjustment screw 128. The uppermost end 129 of adjustment screw 128 bears against the lowermost surface of web portion 114.

In operation, ridged roller 121 is positioned so as to engage the lowermost surface of reed 8 and bear inwardly thereagainst so as to urge the reed securely but slidingly against the mouthpiece. As adjustment screw 128 is rotated, a slight pivoting motion is imparting to pivot arms 123 which tends to rotate ridged roller 121 and thereby longitudinally move reed 8. For example, when adjustment screw is rotated in a clockwise direction as viewed from below, lever arms 123 and ridged roller 121 will be rotated in a counter-clockwise direction to retract reed 8. Conversely, when adjustment screw 128 is rotated in a counter-clockwise direction when viewed from below, lever arms 123 and ridged roller 121 rotate in a clockwise direction to advance reed 8.

Figure 10:
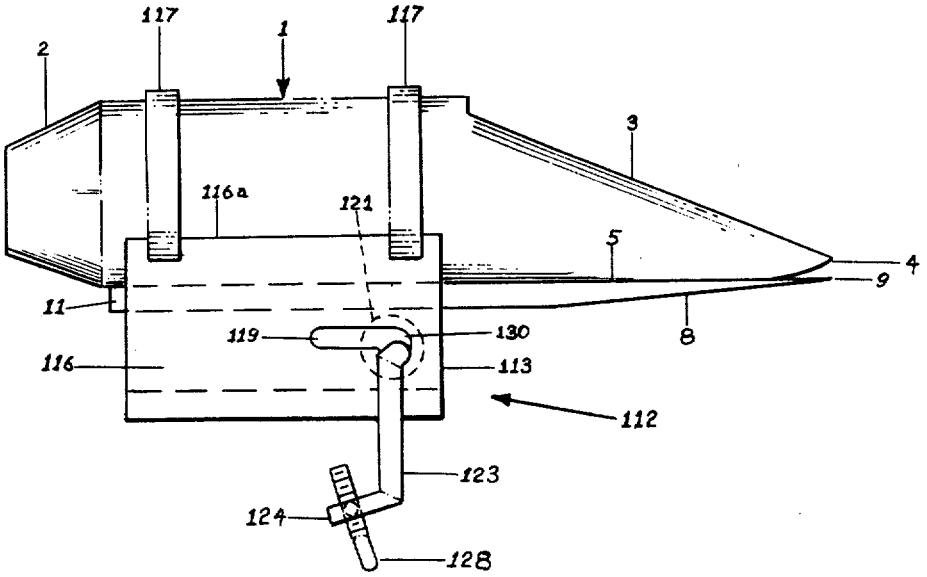
FIG. 10 is a side elevation view of a second embodiment of the mouthpiece of the present invention with the adjustment means in an alternate position.

To facilitate the insertion and removal of reed 8, the forwardmost end of each of slots 119 is provided with an enlarged portion 130. As best shown in FIG. 10, thumb screw 128 may be loosened permitting ridged roller 121 to be moved forwardly and downwardly to the position illustrated. This places the outer surface of the ridged roller out of contact with the underside of reed 8 to facilitate insertion or removal of the reed. After the reed is in place, the entire structure may be moved upwardly and rearwardly to urge the ridged roller 121 against the underside of the reed. The longitudinal position of the reed may be maintained or adjusted by thereafter rotating thumb screw 128.

A third embodiment of the adjustment means of the present invention is illustrated in FIG. 13–FIG. 16, where parts similar to those previously described have been similarly designated. In this arrangement, the cylindrical shafts 120 extending outwardly from ridged roller 121 are rotatably supported in arcuate slots 219 positioned in each of flange members 116.

Figure 15:
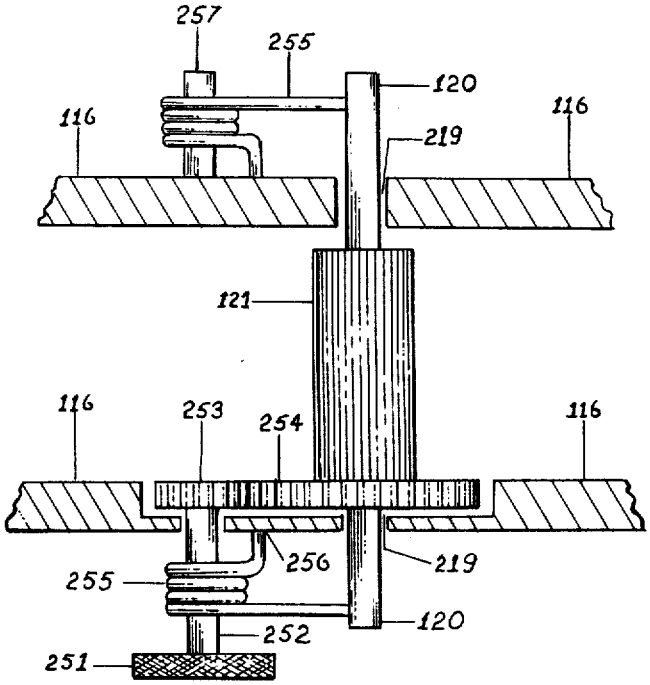
FIG. 15 is an enlarged fragmentary top plan view of one embodiment of the adjustment mechanism usable with the mouthpiece of FIG. 13.

In the embodiment illustrated best in FIG. 15, ridged roller 121 may be rotated by means of a thumb wheel 251 secured to the end of shaft 252 extending outwardly from one of flange members 116 which has connected to its innermost end a first spur gear 253. Gear 253 is arranged to mesh with a larger spur gear 254 which is non-rotatably affixed to one of shafts 120. Consequently, rotation of thumb wheel 251 will cause rotation of ridged roller 121, which in turn will provide longitudinal movement for reed 8 in a manner similar to that described in connection with the embodiment of FIG. 9–FIG. 12.

A coil spring 255 is wrapped about shafts 252 and fixedly secured to flange member 116 as at 256. The opposite end of spring 255 bears against the underside of shaft 120 to urge roller 121 upwardly against the reed 8. Similarly, a boss 257 extends outwardly from the opposite flange member 116 and supports a similar coil spring 255 which also operates to urge the other one of shaft 120 upwardly.

Figure 16:
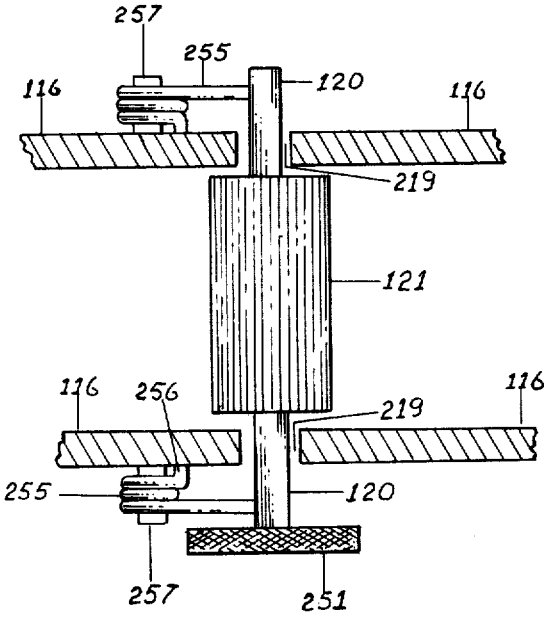
FIG. 16 is an enlarged fragmentary top elevation view of an alternate adjustment mechanism usable with the mouthpiece of FIG. 13.

If desired, gears 253 and 254 may be eliminated, and thumb wheel 251 connected directly to shaft 120 as illustrated in FIG. 16. In this arrangement, shaft 252 is replaced by an outwardly extending boss 257 which supports the first of springs 255. It will be understood, however, that the geared arrangement of FIG. 15 provides for finer adjustment of the longitudinal motion of the reed.

Figure 17:
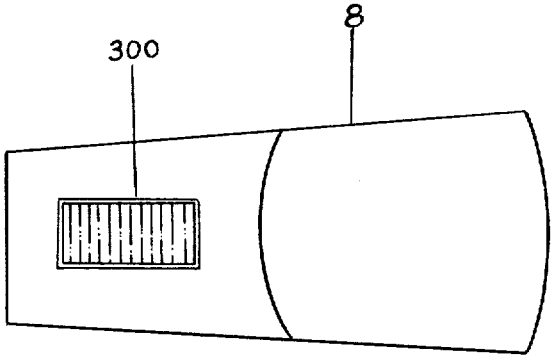
FIG. 17 is a top plan view of an instrument reed having an integral rack-type gear.
Figure 18:
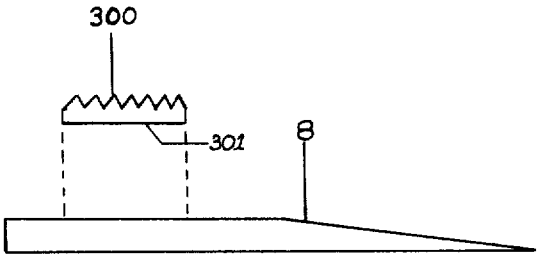
FIG. 18 is a side elevation view of an instrument reed having a separate rack-type adjustment gear.

In some instances, it may be desirable to provide better frictional engagement between reed 8 and ridged roller 121. This may be accomplished as illustrated in FIG. 17 and FIG. 18 by providing, on the lower surface of reed 8 in the area adjacent ridged roller 21, a ridged portion 300 having transversely extending ridges or grooves configured to engage corresponding ridges on roller 121 to create a rack-like gear. Ridged portion 300 may be provided as an integral part of reed 8 by scoring or the like, or may be provided as a separate member as illustrated in FIG. 18 which is secured by an adhesive or the like 301 to the appropriate surface of reed 8. It will be understood that this arrangement provides a rack and pinion-like effect for longitudinally moving reed 8.

Figure 13:
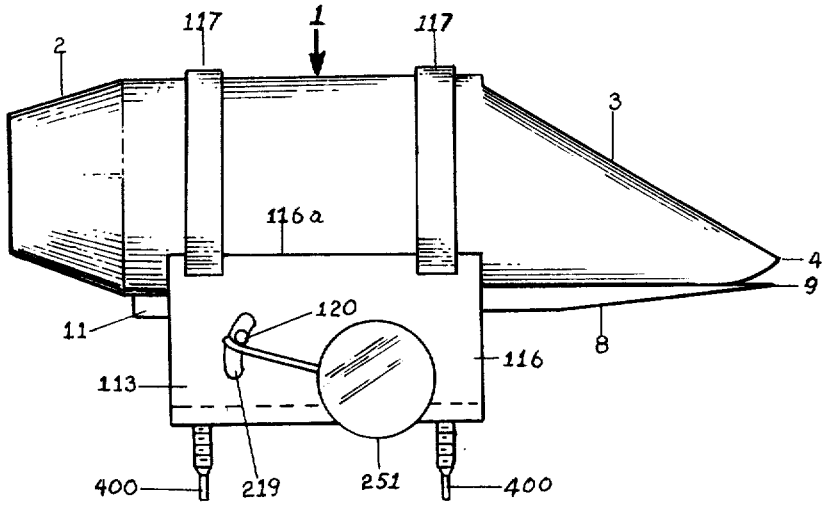
FIG. 13 is a side elevation view of a third embodiment of the mouthpiece of the present invention.
Figure 14:
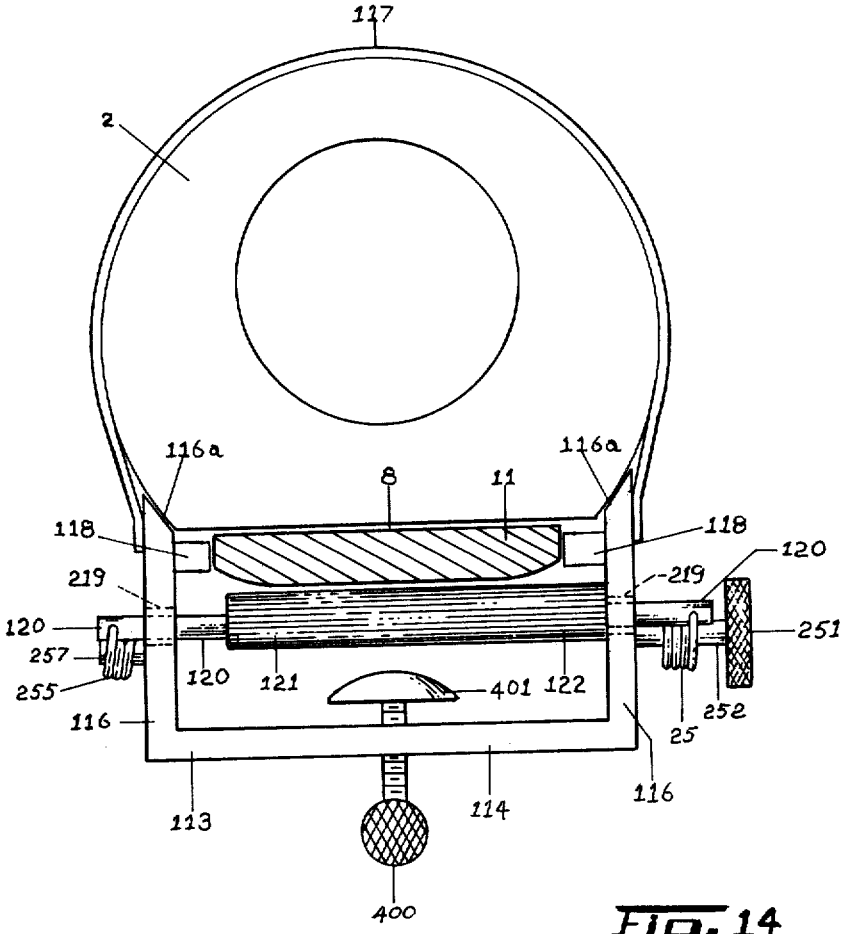
FIG. 14 is an enlarged end elevation view of the mouthpiece of FIG. 13.

In some instances, it may further be desirable to vary the force with which the reed 8 is pressed against the mouthpiece. This may be accomplished as illustrated in FIG. 13 and FIG. 14 by providing auxiliary means for urging the reed against the mouthpiece face in the form of one or more thumb screws 400 which are threadedly engaged in a corresponding threaded aperture in horizontal web portion 114. The uppermost end of the thumb screw is rounded as at 401 to be urged against the underside of the reed and thereby provide an upward pressure against the mouthpiece lay.

It will be especially observed that in each of the embodiments described the performer may vary the longitudinal position of the reed while the instrument is being played in order to select the reed location producing the best results. Consequently, the position of the reed may be quickly changed without the need to disassemble the entire ligature.

It will be understood that each of the embodiments illustrated includes a rotatably mounted roller which operates to urge the reed against the adjacent mouthpiece surface, as well as means for longitudinally adjusting the position of the reed. Furthermore, it will be understood that various changes in the details, materials, steps and arrangements of parts, which have been herein described and illustrated in order to explain the nature of the invention, may be made by those skilled in the art within the principle and scope of the invention as expressed in the appended claims. For example, alternate embodiments of the U-shaped ligature body 113 are illustrated in FIG. 19A and FIG. 19B. In the first of these figures, means are provided on the left-hand flange member 116' for adjusting the spacing between the underside of the mouthpiece face (not shown) and a beveled surface **116*a*. These means are in the form of a threaded set screw 500 which is threadedly engaged within a threaded bore 501 extending longitudinally within flange member 116'. It will be understood that such an adjustment mechanism may be provided on both sides of the ligature body, and may also be provided at several locations along the length of the ligature body. The adjustment means comprising said adjustment set screw 500** enable the performer to adjust the positioning of the ligature body with respect to the mouthpiece to account for variations in the mouthpiece surfaces.

Another embodiment is illustrated in the right-hand portion of FIG. 19A and comprises means for varying the horizontal position of guide **118*a*, which is similar in constructure and operation to fixed guide 118 described previously. In the embodiment illustrated in FIG. 19*a*, guide 118*a* rides within a horizontally extending groove 502 in a vertically extending flange member 116. The horizontal position of guide 118*a* may be moved inwardly or outwardly by means of set screw 503 which is threadedly engaged in a cooperating bore 504 extending through the side of flange member 116*a* into groove 502. This adjustment permits guide 118*a* to make sliding contact with the outer edges of reed 8 (not shown) in order to laterally restrain the reed, and also permits the present invention to be used with a wide variety of reed shapes and sizes. It will be understood that the adjustment mechanism including guide 118*a* may be included in either or both of vertical flange members 116' or 116" at one or more points along the length of ligature body 113**.

An enlarged version of the guide member adjusting means is illustrated in FIG. 19B. In this arrangement, set screw 503 has been replaced by a compression spring 505 which urges the guide member **118*a* inwardly against the side edges of the reed. Spring 505 is housed within a counterbore 506 extending horizontally within vertical flange member 116"**.

The embodiments of the invention in which an exclusive property or privilege is claimed are as follows:

1. In a woodwind musical instrument mouthpiece of the type including a hollow member having a mouth engaging end terminating in a generally arcuate edge and a lower face extending forwardly of said edge configured to mount an elongated reed having a front tip position adjacent said arcuate edge and a rear edge surface spaced rearwardly from said tip and extending downwardly from said lower face, the improvement in combination therewith comprising means for urging said reed against the mouthpiece face comprising a rotatably mounted cylindrical roller and positioned and configured to bear against the outer surface of the reed and means for accurately adjusting the longitudinal position of said reed on the mouthpiece to place the reed tip at a desired location with respect to said arcuate edge.

2. The apparatus according to claim 1 including means for removably securing said adjustment means to said mouthpiece.

3. The apparatus according to claim 1 including means for causing longitudinal movement of said reed to move the reed tip toward and away from said arcuate edge.

4. The apparatus according to claim 1 including means for attaching said adjusting means to said reed.

5. The apparatus according to claim 4 including an elongated reed.

6. The apparatus according to claim 1 wherein said adjusting means comprises a ligature body mounted on said mouthpiece face, yoke means connected to the reed, and micrometer adjusting means joining said yoke means to said ligature body for providing relative longitudinal displacement between said body and said yoke means.

7. The apparatus according to claim 6 wherein said ligature body comprises an elongated channel-shaped member having a generally planar horizontal web portion bearing a downwardly depending boss, a flange member or arm extending upwardly from each outer edge of said web adjacent the marginal edge of said reed, the upper edges of said flange members being configured to abut said mouthpiece face, said micrometer adjusting means comprising a micrometer adjusting screw extending parallel to the reed and threadedly engaging said boss, and said yoke means comprises a reed yoke having a slotted arm rotatably secured at its lower end to said screw and means attached to said arm for connecting said yoke to the rear edge surface of the reed, rotation of said screw causing longitudinal movement of said reed to move the reed tip toward and away from said arcuate edge.

8. The apparatus according to claim 6 wherein said connecting means comprises a threaded fastener extending forwardly from the upper end of said arm for threadedly engaging the rear edge surface of the reed.

9. The apparatus according to claim 1 wherein said urging means comprises a U-shaped roller harness having a lower horizontal web section overlying said ligature body web portion and an arm extending upwardly from each side edge of said web portion adjacent said ligature body flange members, means slidably securing said roller harness to said ligature body for vertical movement therebetween, said securing means comprising a vertical tab extending outwardly from each of said roller harness arms configured to slidably engage a vertically extending slot formed in the inner wall surface of each of said flange members, a cylindrical roller rotatably mounted between said roller harness arms within said roller harness, said roller being positioned and configured to bear against the outer surface of said reed, and a vertically extending pressure adjusting screw threadedly engaging said ligature body web portion and having an upper end bearing against the lower surface of said roller harness web portion to vertically position said roller harness to urge said roller against the reed, said roller permitting longitudinal movement of said web by means of said adjusting means.

10. The apparatus according to claim 1 including a pair of said urging means longitudinally spaced along said reed.

11. The apparatus according to claim 1 wherein said roller includes a plurality of circumferentially spaced longitudinally extending grooves for insuring positive contact with the reed.

12. The apparatus according to claim 11 including a plurality of longitudinally grooves extending laterally across the reed for providing positive contact with said grooved roller.

13. The apparatus according to claim 12 including a separate member bearing said grooves and means for attaching said member to the surface of the reed.

14. The apparatus according to claim 1 wherein said adjusting means comprises said roller and means for rotating said roller to linearly advance or retract the reed.

15. The apparatus according to claim 14 wherein said rotating means comprises a lever arm having one end non-rotatably secured to an end of said roller and means for linearally moving the other end of said arm to rotate said roller in a desired direction.

16. The apparatus according to claim 15 including a U-shaped support having a pair of spaced side portions rotatably supporting the ends of said roller and a web portion connected between said side portions, said roller being positioned between said web portion and the reed, a U-shaped lever arm connected to each end of said roller, a plate bearing a threaded aperture connected for gimballed motion between the opposite ends of said arms, and an adjustment screw threadedly engaging said aperture and having one end bearing against said web portion whereby rotation of said screw imparts a rotary motion to said arm and roller for linearly moving the reed.

17. The apparatus according to claim 16 wherein the ends of said roller are supported in longitudinally extending slots, one end of said slot terminating in an elongated opening permitting said roller to be moved out of engagement with the reed to facilitate insertion and removal of the reed.

18. The apparatus according to claim 16 including a pair of spaced inwardly directed guide members having tapered inner surfaces secured to the inner surface of each side portion and positioned to guide the side edges of the reed to prevent lateral motion thereof.

19. The apparatus according to claim 14 wherein said rotating means comprises a thumb wheel connected to said roller, rotation of said thumb wheel causing rotation of said roller.

20. The apparatus according to claim 19 including gear means connected between said thumb wheel and said roller for imparting rotary motion to said roller.

21. The apparatus according to claim 19 including spring means for urging said roller against the reed.

22. The apparatus according to claim 21 including auxiliary means for urging said reed against the mouthpiece face.

23. The apparatus according to claim 19 including a pair of spaced inwardly directed guide members having tapered inner surfaces positioned to guide the side edges of the reed to prevent lateral motion thereof.

24. The apparatus according to claims 18 or 23 including means for adjusting the position of said guide members to insure abutting contact thereof with the side edges of the reed.

25. The apparatus according to claims 18 or 23 including spring means for urging said guide members inwardly to insure abutting contact thereof with the side edges of the reed.

26. The apparatus according to claims 7 or 9 including means extending upwardly through said arms for adjustably varying the distance between the upper ends of said arms and the mouthpiece body.

* * * * *